US009487994B2

(12) United States Patent
Lenz et al.

(10) Patent No.: US 9,487,994 B2
(45) Date of Patent: Nov. 8, 2016

(54) EDGE BOND BRACKET AND INSULATING GLASS UNIT CONTAINING THE SAME

(75) Inventors: Joerg Lenz, Kassel (DE); Ferdinand Bebber, Kassel (DE); Peter Cempulik, Kassel (DE); Nils Schedukat, Kassel (DE); Norbert Deckers, Kassel (DE); Henrik Stephan, Kassel (DE)

(73) Assignee: Technoform GLass Insulation Holding GmbH, Kassel (DE)

( * ) Notice: Subject to any disclaimer, the term of this patent is extended or adjusted under 35 U.S.C. 154(b) by 1054 days.

(21) Appl. No.: 13/574,356

(22) PCT Filed: Jan. 19, 2011

(86) PCT No.: PCT/EP2011/000205

§ 371 (c)(1),
(2), (4) Date: Aug. 1, 2012

(87) PCT Pub. No.: WO2011/088994

PCT Pub. Date: Jul. 28, 2011

(65) Prior Publication Data

US 2012/0297707 A1 Nov. 29, 2012

(30) Foreign Application Priority Data

Jan. 20, 2010 (DE) ..... 10 2010 005 181
Jan. 21, 2010 (DE) ..... 20 2010 001 242 U

(51) Int. Cl.
*E06B 7/12* (2006.01)
*E06B 3/663* (2006.01)
*E06B 3/66* (2006.01)

(52) U.S. Cl.
CPC ..... *E06B 3/66366* (2013.01); *E06B 3/6621* (2013.01); *E06B 3/66319* (2013.01); *E06B 3/66347* (2013.01); *E06B 2003/66395* (2013.01)

(58) Field of Classification Search
CPC ..... E06B 3/6621; E06B 3/66319; E06B 3/66347; E06B 3/66366; E06B 2003/66395
USPC ..... 52/172, 308, 786.1, 786.13, 788.1
See application file for complete search history.

(56) References Cited

U.S. PATENT DOCUMENTS 2,235,680 A 3/1941 Haven et al.
2,306,327 A * 12/1942 Baldwin et al. ..... 52/172

(Continued)

FOREIGN PATENT DOCUMENTS

CA 2269715 5/1998
DE 26 14 236 10/1977

(Continued)

OTHER PUBLICATIONS

Examination Report dated May 23, 2013 from EPO for counterpart EP application No. 11 701 618.8, including English translation thereof and English translation of claims 1-14 serving as the basis for the Examination Report.

(Continued)

*Primary Examiner* — James Buckle, Jr.
(74) *Attorney, Agent, or Firm* — J-Tek Law PLLC; Jeffrey Tekanic; Scott Wakeman

(57) ABSTRACT

An edge bond bracket for an insulating glass unit extends in a longitudinal direction with a constant cross-section and includes an at least substantially U-shaped bracket body made of a material having a specific thermal conductivity less than or equal to 0.3 W/(mK). The bracket body includes at least one base, a first side wall and a second side wall. At least two troughs are defined in the base between the first side wall and the second side wall for accommodating adhesive and a pane. A gas impermeable diffusion barrier layer is formed integrally on and/or in the bracket body, extends continuously between two troughs starting from an inner wall of one of the two troughs and ending on an inner wall of the other of the two troughs, and extends either along an outer side of the U-shape of the bracket body or through the bracket body.

20 Claims, 9 Drawing Sheets

(56) References Cited

U.S. PATENT DOCUMENTS

| | | | | | |
|---|---|---|---|---|---|
| 2,525,717 | A | | 10/1950 | Ottenheimer | |
| 2,741,809 | A | | 4/1956 | Englehart et al. | |
| 2,838,809 | A | * | 6/1958 | Zeolla et al. | 52/172 |
| 2,934,801 | A | | 5/1960 | Blaszkowski | |
| 2,974,377 | A | | 3/1961 | Kunkle | |
| 3,553,913 | A | * | 1/1971 | Eisenberg | 52/172 |
| 3,758,996 | A | | 9/1973 | Bowser | |
| 3,775,914 | A | * | 12/1973 | Patil | 52/172 |
| 3,872,198 | A | | 3/1975 | Britton | |
| 3,928,953 | A | * | 12/1975 | Mazzoni et al. | 52/172 |
| 4,015,394 | A | | 4/1977 | Kessler | |
| 4,149,348 | A | | 4/1979 | Pyzewski | |
| 4,407,105 | A | | 10/1983 | Frank | |
| 5,460,862 | A | | 10/1995 | Roller | |
| 5,514,432 | A | * | 5/1996 | Lisec | 428/35.8 |
| 5,531,047 | A | * | 7/1996 | Leopold et al. | 52/172 |
| 5,553,440 | A | * | 9/1996 | Bulger et al. | 52/786.13 |
| 6,250,045 | B1 | * | 6/2001 | Goer et al. | 52/786.13 |
| 6,339,909 | B1 | | 1/2002 | Brunnhofer et al. | |
| 6,389,779 | B1 | | 5/2002 | Brunnhofer | |
| 6,537,629 | B1 | | 3/2003 | Ensinger | |
| 6,989,188 | B2 | * | 1/2006 | Brunnhofer et al. | 428/188 |
| 8,756,879 | B2 | * | 6/2014 | Cempulik et al. | 52/172 |
| 2003/0037493 | A1 | | 2/2003 | Guhl et al. | |
| 2007/0261358 | A1 | | 11/2007 | Davis et al. | |
| 2008/0110109 | A1 | | 5/2008 | Hermens | |
| 2008/0134596 | A1 | * | 6/2008 | Brunnhofer et al. | 52/204.6 |
| 2011/0296771 | A1 | * | 12/2011 | Miller et al. | 52/171.3 |
| 2013/0316184 | A1 | * | 11/2013 | Siodla et al. | 428/593 |

FOREIGN PATENT DOCUMENTS

| | | |
|---|---|---|
| DE | 43 41 905 | 6/1994 |
| DE | 94 08 764 | 11/1995 |
| DE | 196 44 346 | 4/1998 |
| DE | 198 05 265 | 4/1999 |
| DE | 20 2005 016 444 U1 | 3/2006 |
| DE | 10 2004 062 060 | 5/2006 |
| EP | 0 029 984 | 6/1981 |
| FR | 1 475 287 | 3/1967 |
| GB | 1 520 257 | 8/1978 |
| WO | 00/05474 | 2/2000 |
| WO | 2006/027146 | 3/2006 |

OTHER PUBLICATIONS

International Search Report for parent International applciation No. PCT/EP2011/000205.

English translation of International Preliminary Report on Patentability for parent International applciation No. PCT/EP2011/000205.

* cited by examiner

PRIOR ART

EDGE BOND BRACKET AND INSULATING GLASS UNIT CONTAINING THE SAME

CROSS-REFERENCE

This application is the U.S. national stage of International Application No. PCT/EP2011/000205 filed on Jan. 19, 2011, which claims priority to German patent application no. 10 2010 005 181.0 filed on Jan. 20, 2010 and to German utility model application no. 20 2010 001 242.2 filed on Jan. 21, 2010.

TECHNICAL FIELD

The present invention relates to an edge bond bracket for an insulating glass unit, an edge bond for an insulating glass unit, an insulating glass unit with edge bond bracket, and a spacer for an insulating glass unit.

RELATED ART

An edge bond for insulating glass units with two or more panes (multi-pane insulating glass=MIG) is usually manufactured in the prior art by using spacers (separation holders) between the panes of the MIG-unit and a back cover made of e.g. butyl. Such an insulating glass unit with an edge bond, as it is shown in an exemplary manner in FIG. 11, is then inserted into a frame or another holder for use as a window, door or facade element. In FIG. 11, a MIG-unit according to the prior art is shown, having three panes 2, two spacers 8 disposed therebetween, and secondary sealant 9 disposed on the side of the spacers 8 opposite to the pane interspaces 7.

Examples of such insulating glass units with composite edge are shown in US 2008/0110109 A1 (DE 10 2004 062 060 B3), DE 20 2005 016 444 U1, U.S. Pat. No. 5,460,862 (DE 43 41 905 A1), U.S. Pat. No. 4,149,348, U.S. Pat. No. 3,758,996, U.S. Pat. No. 2,974,377, U.S. Pat. No. 2,235,680, U.S. Pat. No. 2,741,809 or U.S. Pat. No. 2,838,809 as examples.

An edge bond without separate spacer is shown, for example, in U.S. Pat. No. 4,015,394, which shows a MIG-unit with two panes with an air or nitrogen filling between the panes and an edge bond bracket made of plastic with a base between the panes, on which a metal layer is formed that is impermeable to volatile gases or elements escaping from the plastic of the edge bond bracket, in U.S. Pat. No. 2,525,717 or in U.S. Pat. No. 2,934,801. Spacers are known, for example, from U.S. Pat. No. 6,339,909 (DE 198 05 265 A1) or WO 2006/027146 A1.

Frames, into which the panes of an insulating window are inserted without a prior manufacturing of an edge bond, are shown, for example, in U.S. Pat. No. 3,872,198, GB 1 520 257 or WO 00/05474 A1.

The mechanical strength is usually obtained in insulating glass units with edge bond via the secondary sealing, which is usually comprised of polysulfide, polyurethane, silicone or similar materials. For many usual edge bonds, the MIG-units have to be put on blocks when being inserted into the frames in order to protect the contact faces of the glass from chipping.

SUMMARY

It is an object of the present teachings to disclose an edge bond bracket, an edge bond for an insulating glass unit, an insulating glass unit with an edge bond bracket and a spacer for an insulating glass unit, all of which make possible improved heat insulating characteristics with comparatively simple manufacturing techniques.

A reduction of the thermal loss through the pane edges of an insulating glass unit is made possible. In particular, the thermal losses are significantly reduced in comparison with the use of a secondary sealing.

The edge bond bracket allows a comparatively small dimensioning of the profile, which in turn allows the corresponding MIG-unit without secondary sealing to be set into a position (of the panes) within the framing, which is, in comparison with the prior art, deeper and thermally more advantageous.

The comparatively small dimensioning of the profile of the edge bond bracket allows, while maintaining a conventional insertion depth, a smaller and thus thermally advantageous cross-sectional area in the direction of the heat conduction of the frame or framing.

The edge bond bracket makes it possible to omit the use of support blocks.

The use of the edge bond bracket with integrated gas diffusion barrier makes it possible to minimize the layer thickness of the gas diffusion barrier.

BRIEF DESCRIPTION OF THE DRAWINGS

Further features and advantages follow from the description of embodiments referring to the Figures.

The figures show.

DETAILED DESCRIPTION OF THE INVENTION

Figure 1:
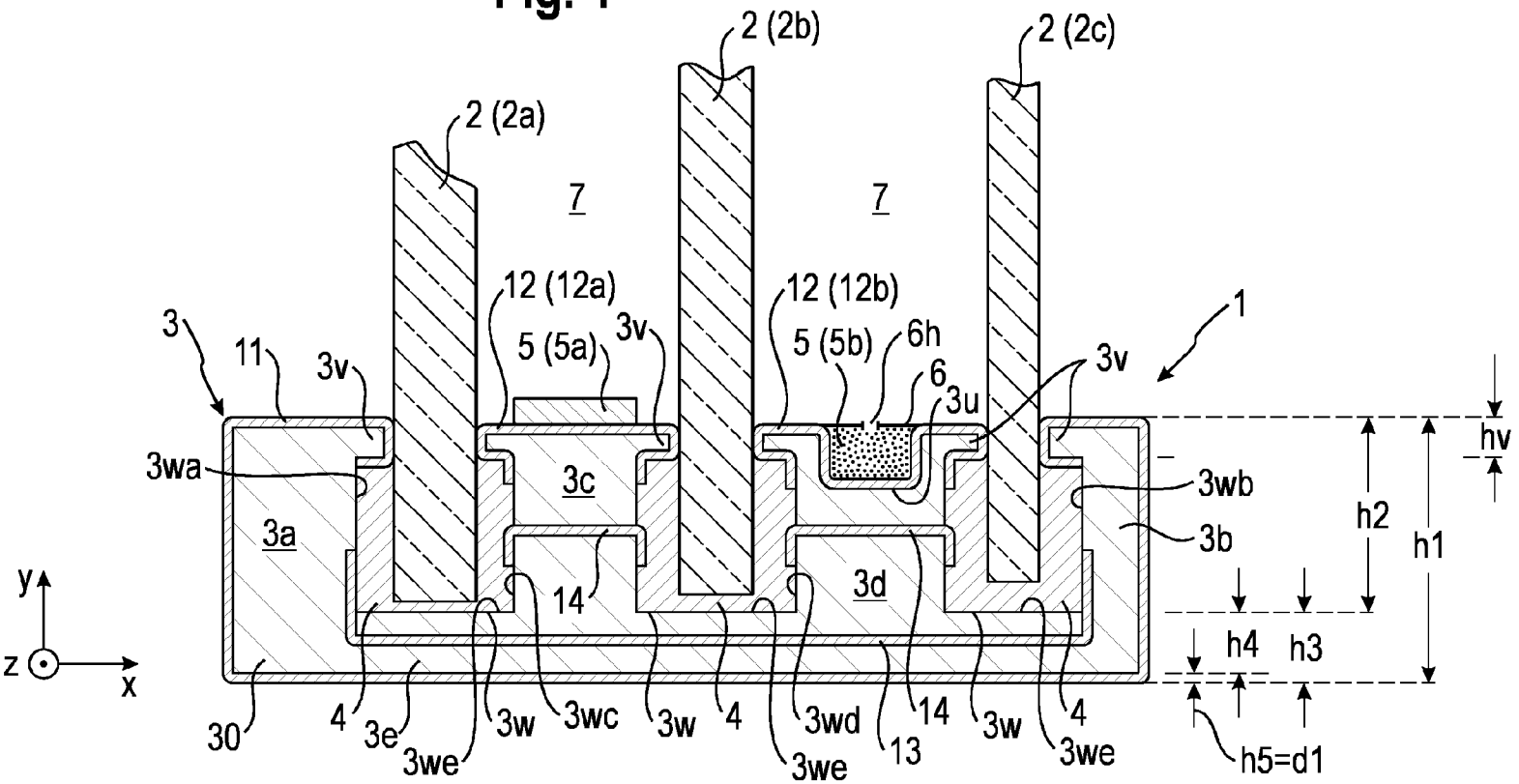
FIG. 1 a cross-sectional view through an edge bond of a triple insulating glass unit, in which multiple embodiments without spacer are shown.

FIG. 1 shows a first embodiment of an edge bond bracket 3 in the edge bond of a multi-pane insulating glass unit (MIG-unit) 1. In the first embodiment, the layers indicated with reference numerals 12, 13, 14 are not present, which are described in connection with further embodiments referring to FIG. 1. In the first embodiment, which is described first, only the layer indicated with reference numeral 11 and described further below is present. This is mentioned at first for a better understanding of the description.

The edge bond bracket 3 comprises an edge bond bracket body 30 made of a heat insulating material with a specific thermal conductivity of ≤0.3 W/(mK) such as a corresponding polyolefin, preferably polypropylene (PP) or polyvinyl chloride (PVC) or a polycarbonate-Acrylonitrile Butadiene Styrene (ABS), blend, which have thermal conductivities in the range of 0.2 W/(mK). These materials are, as will be described further below, preferably provided with suitable fillers, such as, for example, glass fibers.

In FIG. 1 and all following drawings, the horizontal direction is indicated with x, the vertical direction is indicated with y and the direction protruding (perpendicularly projecting) from the plane of the paper is indicated with z. The corresponding directions are shown in FIG. 1 with a 3-D coordinate system. The bracket body 30 extends in a longitudinal direction z with an unvarying cross-section in each plane (x-y) perpendicular to its longitudinal direction z, as the cross-section is shown in FIG. 1. The bracket body 30 has a U-shape in cross-section. The U-shape is formed by two parallel side walls 3*a*, 3*b*, which form the legs of the U-shape, and a base wall 3*e*, which extends perpendicular to the side walls 3*a*, 3*b* in transverse direction x and connects the two side walls 3*a*, 3*b*. The U-shape has a height h1 in height direction y, wherein the side walls have a height h2.

In the first embodiment shown in FIG. 1, two bases 3*c*, 3*d* are provided between the legs of the U-shape, which bases project perpendicularly in the height direction y from the base wall 3*e* in the same direction as the side walls 3*a*, 3*b*, and which bases extend in the longitudinal direction z, like the side walls 3*a*, 3*b*, with a separation from each other and with a separation from the side walls 3*a*, 3*b*. This also follows from the indication that the edge bond bracket 3 has a constant cross-section in the longitudinal direction z, as shown in FIG. 1.

For the embodiment shown in FIG. 1, it is necessary to imagine that the layers 12, 14 are not present in the bases 3*c*, 3*d*. Both bases 3*c*, 3*d* have the same cross-section shape as shown for the left base 3*c* in FIG. 1.

Figure 12:
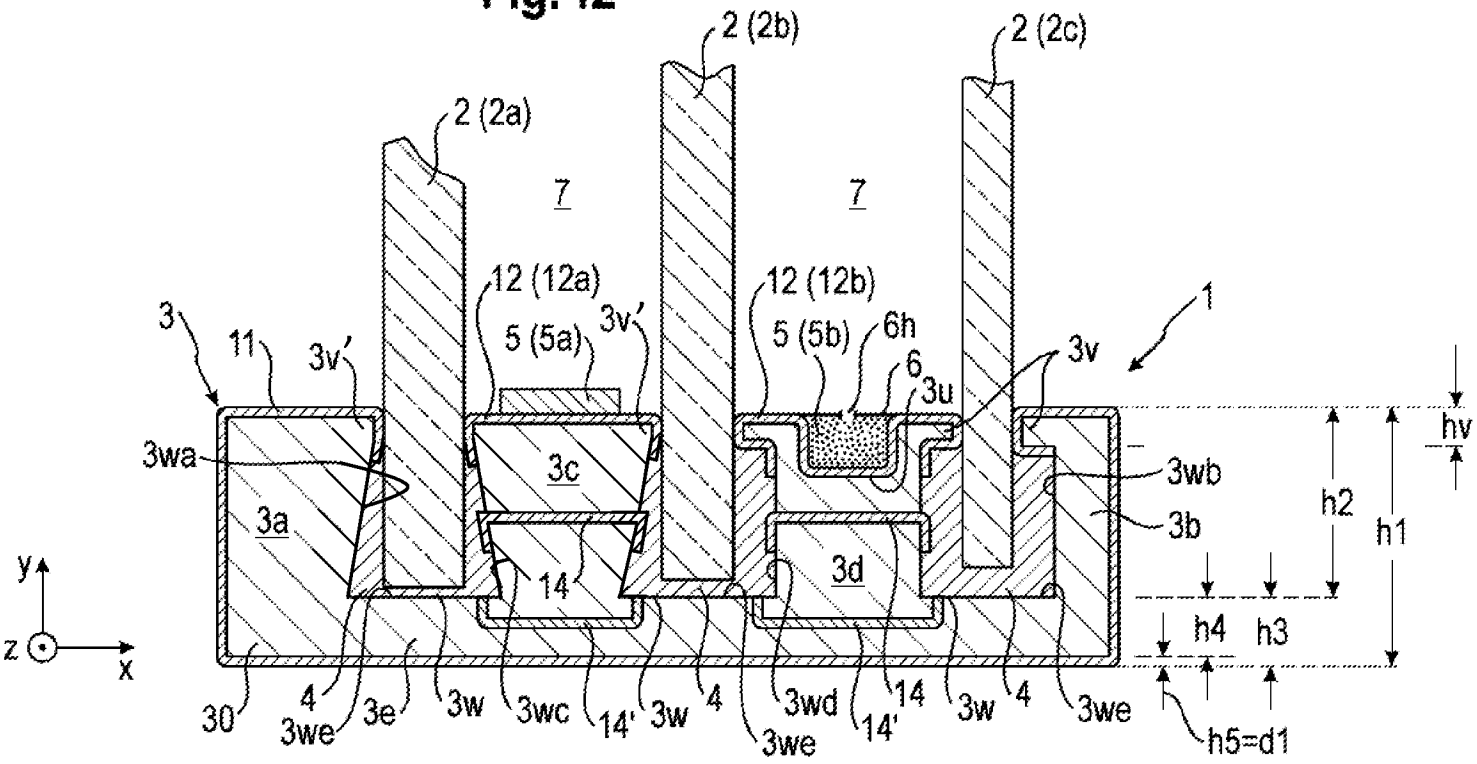
FIG. 12 a modification of the embodiments shown in FIG. 2.

Three troughs 3*w*, which are open at the top, are defined by the corresponding design of the side walls 3*a*, 3*b* and the bases 3*c*, 3*d* together with the base wall 3*e*, wherein the first trough 3*w* is defined between the first side wall 3*a* and the first base 3*c*, the second trough 3*w* is defined between the first base 3*c* and the second base 3*d*, and the third trough 3*w* is defined between the second base 3*d* and the second side wall 3*b*, each having the base wall 3*e* as the bottom (wall). The first trough 3*w* is delimited in the transverse direction x by an outer wall 3*wa* of the first side wall 3*a*, the upper wall 3*we* of the bottom 3*e* and the side wall 3*wb* of the first base 3*c*. In analogous manner, the second and third troughs 3*w* are delimited by the upper wall 3*we* of the bottom 3*e* and the corresponding side walls 3*wc*, 3*wd* and 3*wb* of the first base 3*c*, the second base 3*d* and the second side wall 3*b*. Protrusions 3*v* are formed at the upper ends in the height direction y of these side walls in the first embodiment shown in FIG. 1. The height hv in the height direction of these protrusions is preferably in the range of $1/5^{th}$ to $1/12^{th}$ of the height h2, preferably $1/8^{th}$ to $1/10^{th}$ of h2. The protrusions 3*v* are optional. Alternatively, the side walls of the troughs 3*w* may extend in the height direction exclusively perpendicular to the transverse direction x or they may extend in the height direction y such that the trough 3*w* tapers (narrows) in the height direction y towards the opening, as shown in FIG. 12 and explained further below. The protrusions 3*v* are also preferably formed together with the tapering.

A gas diffusion barrier 11 is provided in the first embodiment, which is formed as a gas-impermeable metal foil or metal layer or foil or layer of a gas-impermeable plastic. Gas-impermeable means that it is formed with a thickness resulting in that a gas diffusion barrier is formed, which is gas tight in the sense of DIN EN 1279 Part 3 (≤1% gas loss/year for argon). For a metal foil or a metal layer such a gas-impermeability is reliably achieved for a layer thickness of ≤0.2 mm. Preferably, when a metal such as stainless steel, zinc-coated steel or the like is used, the layer thickness is ≤0.1 ram, preferably ≤0.05 ram, more preferred ≤0.01 ram. A precise layer limit can not be indicated in isolation, but it is clearly defined for the skilled person by the previously defined gas tightness. A lower limit of 1 μm or 2 μm is not unrealistic. A suitable plastic would be Ethylene Vinyl Alcohol (EVOH), such as, for example, Soarnol® manufacturer Nippon Gohsei.

The gas diffusion barrier 11 extends, in case the protrusions 3*v* are present, from the inner outside wall 3*wa* of the first side wall 3*a*, i.e. the wall 3*wa* delimiting the first trough 3*w* in the transverse direction x at the outside, via the protrusion 3*v* on the first side wall 3*a* over the complete outer side of the bracket body 30, i.e. over the first side wall 3*a*, the base wall 3*e* and the second side wall 3*b* to the inner outside wall 3*wb* of the second side wall 3*b*, which defines/delimits the third trough 3*b* at the outside in the transverse direction x. Naturally, the diffusion barrier 11 can extend further along the outer sides 3*wa*, 3*wb* in the height direction y towards the bottom, but this is not inherently necessary in view of the function.

As can be seen from FIG. 1, three troughs 3*w* are defined by this design of the edge bracket 3, into which the glass panes 2 of an insulating glass unit may be inserted, which are adhered and sealed in the troughs 3*w* by using a gas-impermeable adhesive 4 such as butyl.

The width in the transverse direction x of the troughs 3*w* is dimensioned such that it corresponds at the side of the opening in the position, where the protrusions 3*v* are opposite to each other in FIG. 1, to the thickness of the panes 2 in the transverse direction x. This is already preferable for aesthetic reasons, because these positions can be seen in the actual use of the insulating glass unit through the pane interspaces 7. However, it is also preferable from a technical view, so that no adhesive 4 leaks out. In order to avoid that the troughs 3*w* have to be completely filled with adhesive 4, it is preferable if the diffusion barrier 11 is extended further down along the walls 3*wa*, 3*wb*, for example, by $1/6^{th}$ to $1/10^{th}$ of the height h2, preferably $1/8^{th}$, than the protrusions 3*v*.

Figure 3:
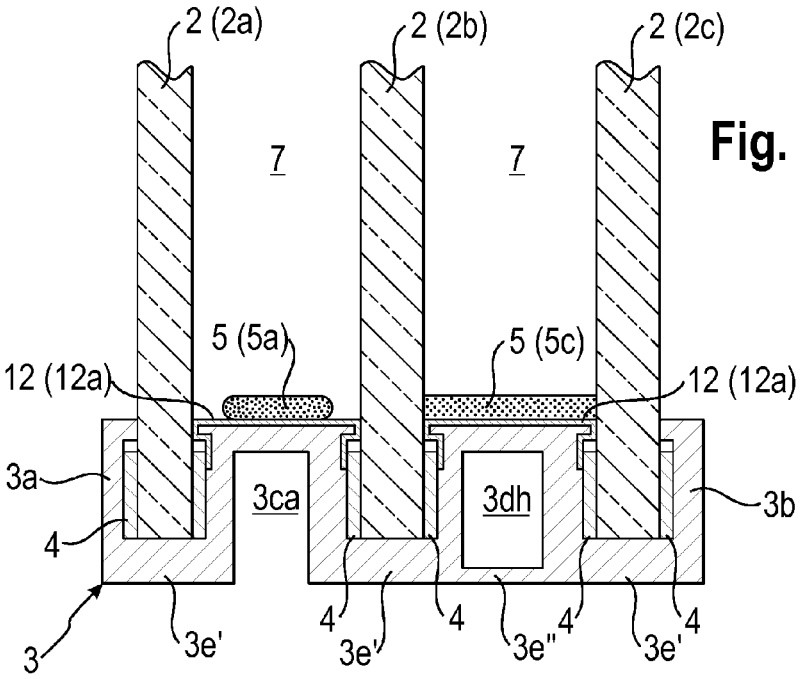
FIG. 3 a cross-sectional view through an edge bond of a triple insulating glass unit, in which one further embodiment without spacer is shown.

In the assembled state of the insulating glass unit, as it is shown in FIG. 1, the diffusion barrier 11 has, in cooperation with the gas-impermeable adhesive 4, which may be, for example, butyl, the effect that a gas-impermeable retention of the panes 2 is achieved, without it being necessary to use secondary sealing (see FIG. 3). The mechanical strength of the assembly is provided by the bracket body 30, which additionally provides an edge protection, etc.

The layer thickness of the diffusion barrier 11 was already described. In the following, as shown in FIG. 1, it is indicated with h5 in relation to the height of the edge bond bracket 3 and with d1 in relation to a layer thickness. The base wall 3*e* of the edge bond bracket 3 has a height h3, which is formed by the height h4 of the bracket body 30 in the region of the base wall 3*e* and the layer thickness h5=d1 of the diffusion barrier 11. The height h4 is preferably in the range of 1 to 5 mm, preferably 1 to 3 mm, preferably ca. 2 mm, such that the height h3 is essentially identical to the height h4, because the amount of h5 is negligible in comparison, in particular with the preferred embodiments having h5≤0.01 mm.

The height h2 is preferably in the range of 4 to 15 mm, preferred 5 to 10 mm, more preferred 5 to 8 mm. Therefore, the height h1 is preferably not more than 25 mm, more preferred not more than 20 mm, even more preferred not more than 15 mm, preferred in the range of 7 to 15 mm.

The widths of the bases 3*c*, 3*d* may be different and the corresponding distances of the bases from the side walls and from each other may be different (or identical), depending upon which thickness the corresponding glass panes 2*a*, 2*b*, 2*c* to be inserted have in the transverse direction x.

Now, the second embodiment will be described referring to FIG. 1. In this respect, the layers 11, 13, 14 are disregarded and only the layer 12 on the first and second bases 3*c*, 3*d* is present. This layer 12 is again a diffusion barrier like the diffusion barrier 11 and the same is true as described above for the layer thickness d1 as well as for the materials and the extension in the height direction y of diffusion barrier 11. That means, the diffusion barrier 11 extends from the upper side of the base 3*c* and on both sides over the protrusions 3*v* (if present) onto the side walls 3*wc* and 3*wd*, respectively, and there, depending on the intended filling level of the troughs 3*w* with adhesive 4, down to a corresponding depth. If the protrusions v are present, which measure in the range of $1/3^{th}$ to $1/12^{th}$ of h2 in the height direction y, it further extends in the depth direction by this amount. In case the protrusions 3*v* are not present, they extend down to a corresponding depth ($2/3^{th}$ to $1/6^{th}$ of h2), depending on the intended filling of the trough 3*w* with adhesive 4.

In FIG. 1, an adhesive bead is shown on the first base 3*c*, which is comprised of a known molecular sieve 5 (5*a*). The molecular sieve 5 can also be identified as a desiccant. A recess 3*u* is shown in the second base 3*d*, which is filled with a molecular sieve/desiccant 5 (5*b*). The recess 3*u* is closed with cover 6, which has perforations 6*h* (in a known manner), so that the desiccant can communicate with the pane interspace 7. In the embodiment of the base 3*d* shown in FIG. 1, the diffusion barrier 12 is formed such that it lines the recess, i.e. it completely covers all inner walls of the recess 3*u* (not the cover 6). The first base 3*c* and the second base 3*d* can as well be formed in the same way. Of course, the corresponding deposition of the molecular sieve 5*a* as a bead or the corresponding deposition of the molecular sieve 5*b* in a recess 3*u*, optionally in a chamber having a cover and perforations, can also be provided in the first embodiment. In this case, however, the diffusion barrier 12 is missing, because the diffusion barrier 11 is present in such a case. Alternatively, the recess 3*u* can be used for inserting a container for the molecular sieve/desiccant 5. That means that instead of depositing the molecular sieve/desiccant 5 directly into the recess/depression 3*u*, the same is designed for receiving and fixing a container, for example, by clipping or latching or adhering or the like, in which container a molecular sieve/desiccant 5 is contained. In such a case, the container is again not formed in a gas-impermeable manner to the pane interspace 7, for example, by being open at the top or by having perforations or by having a gas permeable top side.

Now, a third embodiment will be described referring to FIG. 1. In this case, only the layer 13 is present. The layers 11, 12, 14 are not present. In the third embodiment, the diffusion barrier 13 is again a layer made of materials and having the corresponding thicknesses as were described for the diffusion barrier 11 in the first embodiment. The diffusion barrier 13 extends from the inner outside 3*wa* of the first side wall 3*a*, which defines the first trough 3*w* to the outside, continuously to the inner outside 3*wb* of the second wall 3*b*, which defines the third trough 3*b* in the transverse direction to the outside, through the bracket body 30. It is essential in this respect that the diffusion barrier 13 comes into contact with the adhesive 4. It could as well extend from the base wall 3*e*, which delimits the first and third trough 3*w*, respectively, through the bracket body 30. It is not important in this respect whether it extends through the bracket body or along the bottoms of the first to third troughs 3*w*.

Now, a fourth embodiment will be described referring to FIG. 1. In the fourth embodiment, the layers 11, 12, 13 are not present, but only the two diffusion barriers 14 are present, which are again formed as layers having the thickness d1 and the corresponding materials, which were already described with respect to the first embodiment.

The diffusion barriers 14 extend in the transverse direction x transversely through the bases 3*c*, 3*d*, each to the corresponding troughs 3*w* located at the two outer sides of the bases.

Figure 2:
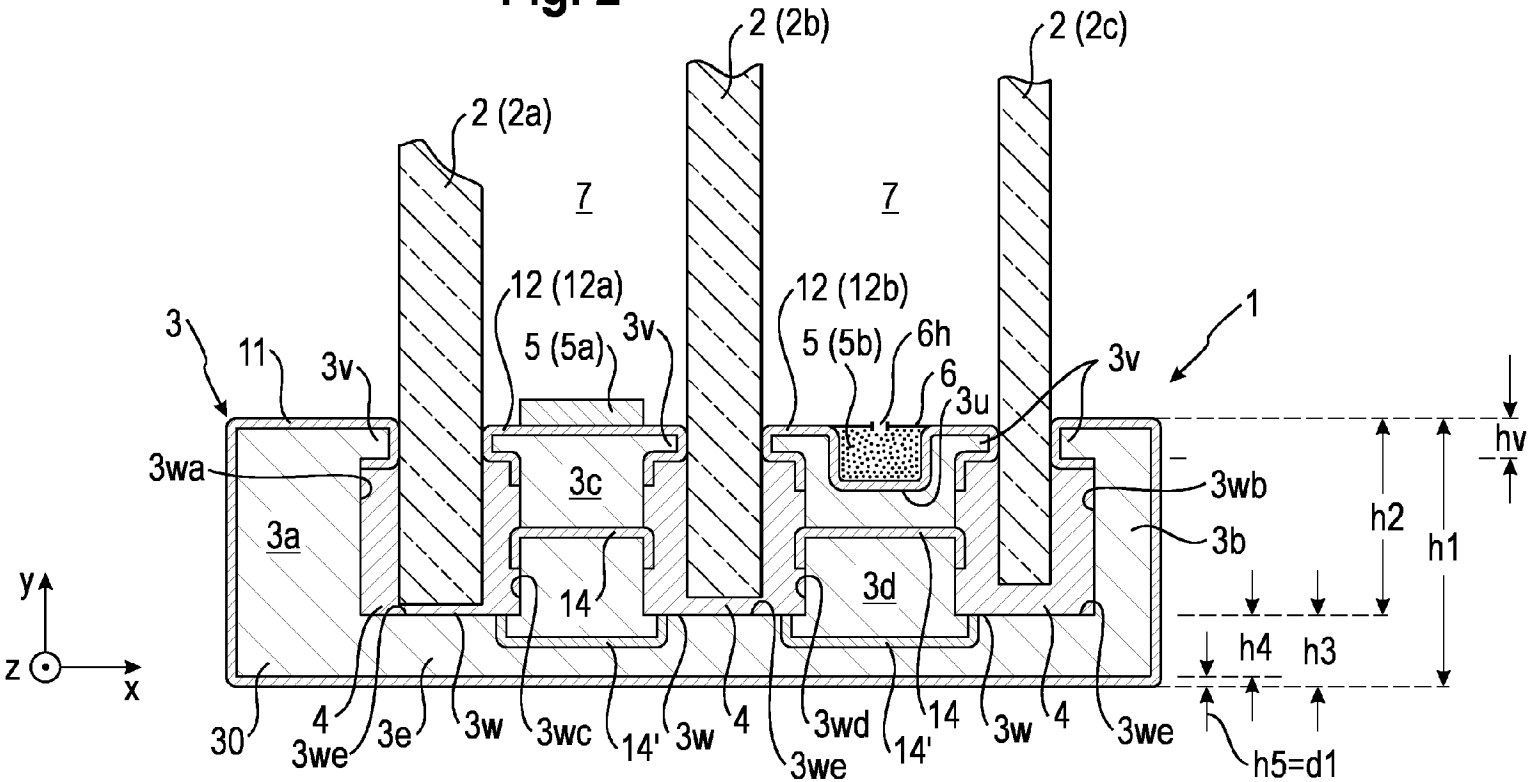
FIG. 2 a cross-sectional view through an edge bond of a triple insulating glass unit, in which multiple embodiments without spacer are shown.

FIG. 2 shows a modification of the fourth embodiment. In the modification of the fourth embodiment, the layers 11, 12, 14 are not present, but only the two diffusion barriers 14' are present, which are again formed as layers having the thickness d1 and the corresponding materials, which were already described with respect to the first embodiment. The diffusion barriers 14' extend continuously (like the diffusion barriers 14) from the inner walls of two adjacent troughs 3*w*, but in this case not starting from the inner side walls 3*wc*, 3*wd*, but rather from the bottom walls 3*we* of the bottoms 3*e* through the bracket body 30. Preferably, they extend in transverse direction x below the level of the bottom walls 3*we*, but like in all other embodiments, with a continuous, uninterrupted connection to the inner walls of the troughs. In the shown modification this is implemented by the, in the cross-section (x-y), flat U-shape of the layer.

FIG. 12 shows a modification of the first to fourth embodiments that were described above in connection with FIGS. 1 and 2, in which the outer wall 3*wa* of the first side wall 3*a* tapers and ends in a taper end portion 3*v'*. In addition, both of the outer side walls 3*wc* of the first base 3*c* also taper and end in respective taper end portions 3*v'*. Therefore, two of the troughs 3*w* taper (narrow) in the height direction y towards the opening.

All other descriptions of the first embodiment apply in the same way to the second to fourth embodiments.

When the second, third or fourth embodiment is used in an insulating glass unit, as shown in FIG. 1, 2, the results are, again like in the first embodiment, effective diffusion barriers for the pane interspaces 7 by the cooperation of the corresponding diffusion barriers 12, 13, 14 and 14', respectively, with the adhesives 4 in the troughs 3*w*, as it is obvious from FIG. 1, 2.

Figure 11:
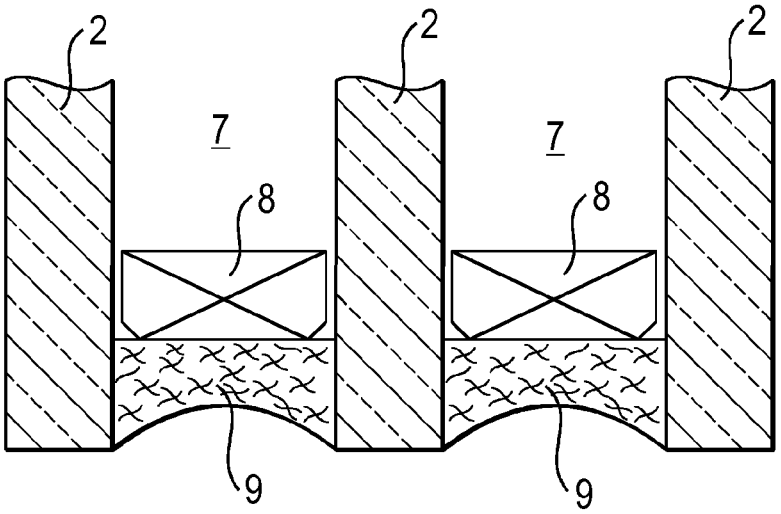
FIG. 11 a conventional MIG-unit in a cross-sectional view.

It is common to the first to the fourth embodiments that a U-shaped profile is used as an edge bond bracket 3, which is formed with a number of bases 3*c*, 3*d* for forming troughs 3*w* for receiving the panes, which number corresponds to the number (minus 1) of panes of the MIG-unit 1 (i.e., e.g., three bases in case of four panes). It is obvious that the use of spacers 8 as well as the use of secondary sealant 9, as it is shown in FIG. 11, can be omitted.

The heat insulating characteristics are improved thereby in many ways. The omission of the secondary sealant having a specific thermal conductivity, which is usually inferior by a factor of 2 or more in comparison to the plastic of the bracket body 30, leads, together with the possible dimensioning of the base wall, to a significant reduction of the heat conduction, without sacrificing the gas tightness and/or the strength, but with a simultaneous gain of edge protection and manageability.

A further gain in the improvement of the heat insulating characteristics is made possible by the possible construction of the edge bond with a lower height, which enables, with the same frame configuration, an increased insertion depth into the frame.

In FIG. 3, a fifth embodiment of an edge bond bracket 3 for use without a spacer is shown. In FIG. 3, the same reference numerals indicate the same elements as in FIG. 1, 2, and their description is omitted for this reason.

Different from the first to fourth embodiments of FIGS. 1 and 2, the edge bond bracket 3 does not comprise a continuous base wall 3*e*, but rather each of the troughs 3*w* is provided with a separate section 3*e*' of the base wall as its bottom. This enables the forming of recesses 3*ca* or of a cavity 3*dh*, which is closed by a wall 3*e*", in the bases 3*c*, 3*d*, respectively. In FIG. 3, a further modification of the deposition of the molecular sieve/desiccant 5 (5*c*) on the base 3*d* is shown, which is adhered in form of a correspondingly formed adhesive tape. The forming of the recesses 3*ca* and/or cavities 3*dh* with base wall sections 3*e*", which have a reduced height, results in a further improvement of the thermal insulating characteristics.

Naturally, the fifth embodiment shown in FIG. 3 can also be modified in accordance with the first, second and fourth embodiments of FIGS. 1 and 2 with respect to the diffusion barrier layer. That means, a diffusion barrier layer could extend, corresponding to the diffusion barrier 11, over the outer side, and the diffusion barrier could also extend in the bracket body corresponding to the diffusion barriers 13 and 14, 14', respectively.

Furthermore, although it is not shown in FIGS. 1 to 3, it is preferred that functional elements (see also FIG. 5), such as recesses for fitting elements or connection elements such as protrusions for rolling-in or the like, could be formed at the edge bond bracket 3, if it is necessary.

The edge bond bracket 3 can, for example, be manufactured by extrusion of the bracket body 30 and by adhering, laminating or the like the diffusion barrier layer 11, 12, 13, 14, 14' or, for example, by coextruding the bracket body 30 and the diffusion barrier layer 11, 12, 13, 14, 14'.

Now, referring to FIGS. 4 to 8, embodiments will be described, in which the edge bond is manufactured using an edge bond bracket 3 and spacers 8, but, except for FIG. 8, without secondary sealant. In FIGS. 4 to 8, corresponding elements are indicated with the same reference numerals as in FIGS. 1 to 3 and the description of the same will be omitted, i.e., reference is made to the corresponding description of the elements with respect to FIGS. 1 to 3. This is true in particular for all parts of the description with respect to the materials and dimensions of the diffusion barriers and of the bracket body and of their components, as far as applicable.

Figure 4:
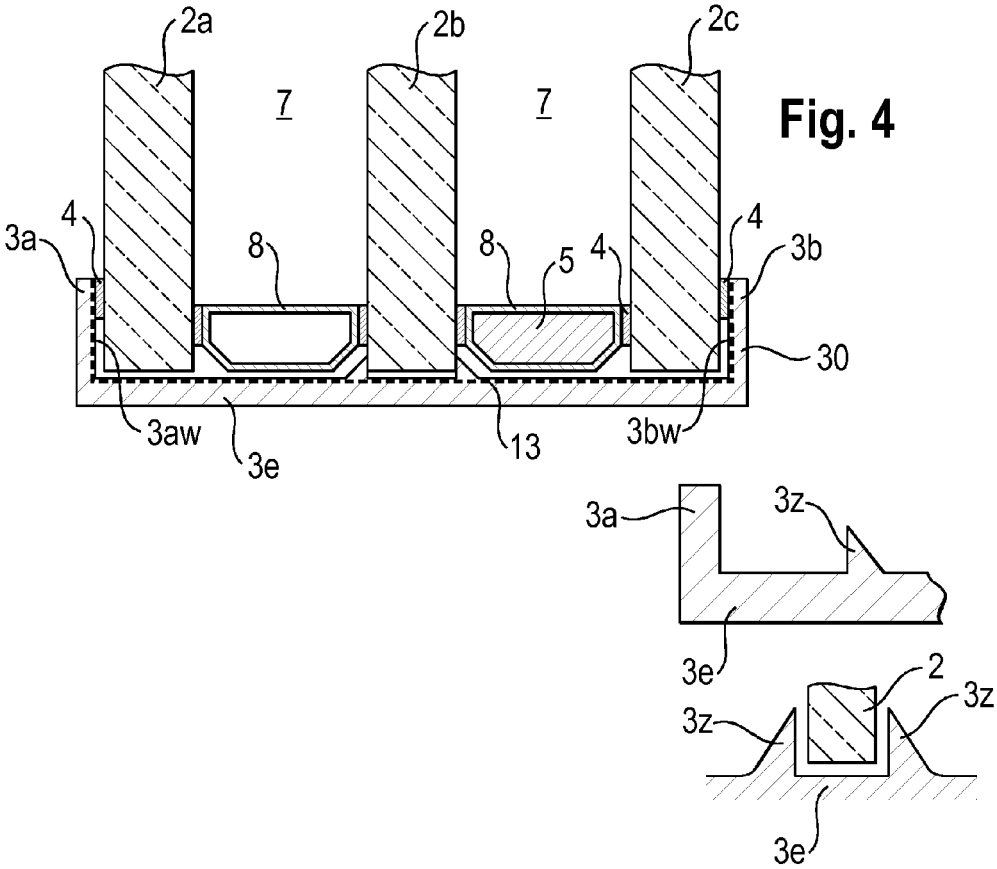
FIG. 4 a sixth embodiment with spacer and a modification of the same.

In the sixth embodiment shown in FIG. 4, an edge bond is manufactured in the conventional way shown in FIG. 11 by using spacers of a conventional type (with or without diffusion barrier), by connecting the same using primary sealant/adhesive 4 such as butyl adhesive with the panes by forming pane interspaces 7, but without secondary sealant and thus with spacers which are correspondingly located further outside towards the pane edge. The spacers 8 can be bent in a conventional manner in the corner areas or can be assembled using corner connectors. Desiccant 5 can be provided in the cavities of the spacer 8 in a conventional manner.

In the embodiment shown in FIG. 4, instead of using secondary sealant (see FIG. 11), a U-shaped bracket 3 is provided that includes first and second side walls 3*a* and a base wall 3*e* like in FIGS. 1 to 3. The side walls 3*a*, 3*b* optionally can be provided with protrusions 3*v*. In the sixth embodiment shown in FIG. 4, the spacers 8 include diffusion barrier layers in a conventional manner, such that the combination of the diffusion barrier layer of the spacers 8 and of the adhesive 4, which seals the interspace to the pane 2 adjacent to the diffusion barrier of the spacer 8, seals the pane interspaces 7 in a gas-impermeable manner in the sense of the above definition. The mechanical strength of the edge bond is obtained via the bracket 30.

Preferably, the bracket 3 comprises protrusions 3*z* on the base wall 3*e*, protruding in height direction y, which serve to position the one or more panes 2*b* of the MIG-unit, which are not positioned at the outside. This can be recognized in the two enlarged views on the right bottom side in FIG. 4.

In a modification of the sixth embodiment, the spacers 8 do not have any diffusion barrier layers, but rather the diffusion barrier layer is, in the manner described with respect to the first or third embodiment, integrated in the edge bond bracket 3. That means, a layer 11 corresponding to the diffusion barrier layer 11 of FIGS. 1, 2 is formed continuously from the mutually-opposing outer sides 3*aw*, 3*bw* of the side walls 3*a*, 3*b* over the entire outer side, such that, in connection with the adhesive 4 used on these walls, a gas-impermeable diffusion barrier is achieved. Alternatively, this also can be achieved with a diffusion barrier 13 that corresponds to the diffusion barrier 13 of FIG. 1 and extends on the inner side of the U-shape or in the bracket body 30.

Figure 5:
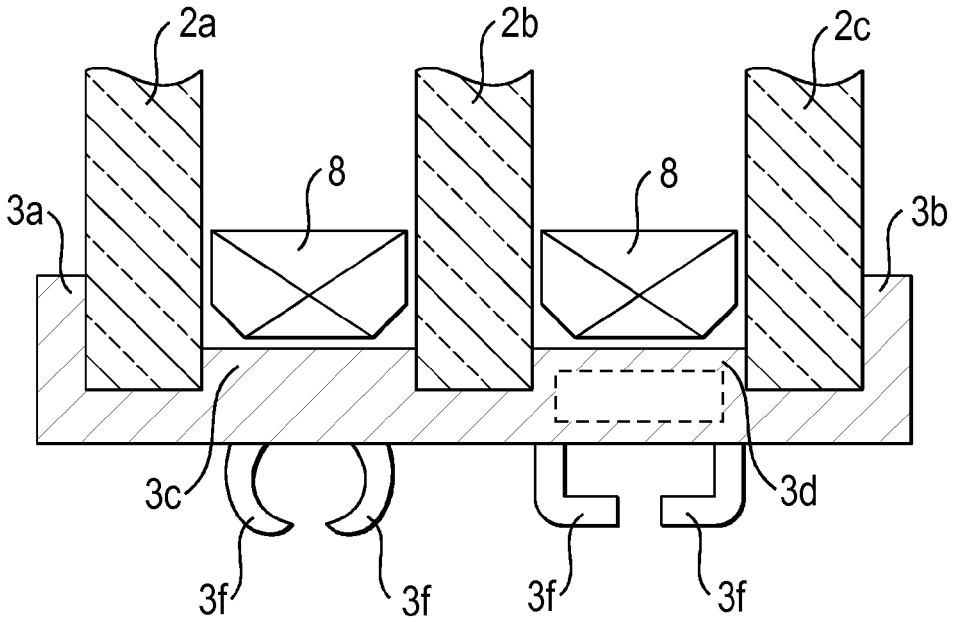
FIG. 5 a seventh embodiment with spacer and a modification of the same.

A seventh embodiment is shown in FIG. 5. The seventh embodiment differs from the sixth embodiment in that the bases 3*c*, 3*d* are provided, the positioning of which corresponds to the positioning of the first and second bases 3*c*, 3*d* of the first to fifth embodiments. Different from the first to fifth embodiments, the bases have a lower height than the two side walls 3*a*, 3*b*. In the embodiment shown in FIG. 5, again the spacers 8, which are only shown in a schematic manner, include the diffusion barrier layer, which again in connection with the corresponding adhesive 4 between the panes 2 and the spacers 8, secure the gas-impermeable sealing of the pane interspaces 7, while the bracket 3 provides for the mechanical strength. In corresponding modifications of the seventh embodiment, all features of the diffusion barriers 11, 12, 13, 14, 14' can be used in the way described with respect to FIGS. 1 to 3. As indicated in FIG. 5 by the dashed line, the modifications such as recesses and cavities, which are shown in FIG. 3, can be also used.

Furthermore, functional elements, i.e., e.g., attachment elements, recesses for fitting elements, connection elements for rolling-in, and the like, are schematically indicated on the bottom side of the base wall 3*e* in FIG. 5.

In the eighth embodiment shown in FIG. 6, the bracket 3 is again adapted for the usage of spacers. Here, a modified shape of the spacers 8*h* is used, which has, in the cross-section perpendicular to the longitudinal direction z, a "hat-shape", wherein the hat brim 8*hk* protrudes in the transverse direction x beyond the width of the portion of the spacers 8*h*, which are positioned between the panes 2*a*, 2*b* and 2*c*, respectively. Thereby, it is achieved that the lower sides of the panes in the height direction y stand on the protrusions/brims 8*hk*. This improves the mounting possibilities before the inserting of the bracket 3. The bracket 3 comprises, adjacent to the side walls 3*a*, 3*b*, protrusions 3*h* on the base wall 3*e*, the height of which corresponds to the height of the protrusions/brims 8*hk* of the spacers 8*h*. The widths of the brims 8*hk* may alternatively be selected such that they correspond exactly to one-half of the thickness of the panes, such that no empty space 8*hz* remains between adjacent spacers 8*h*, or less.

The eighth embodiment shown in FIG. 6 can again include the diffusion barrier either by the provision of corresponding diffusion barriers in the spacer 8*h* or by the provision of corresponding diffusion barrier layers corresponding to the first or third embodiments, i.e. corresponding to diffusion barrier layers 11 or 13.

Figure 7:
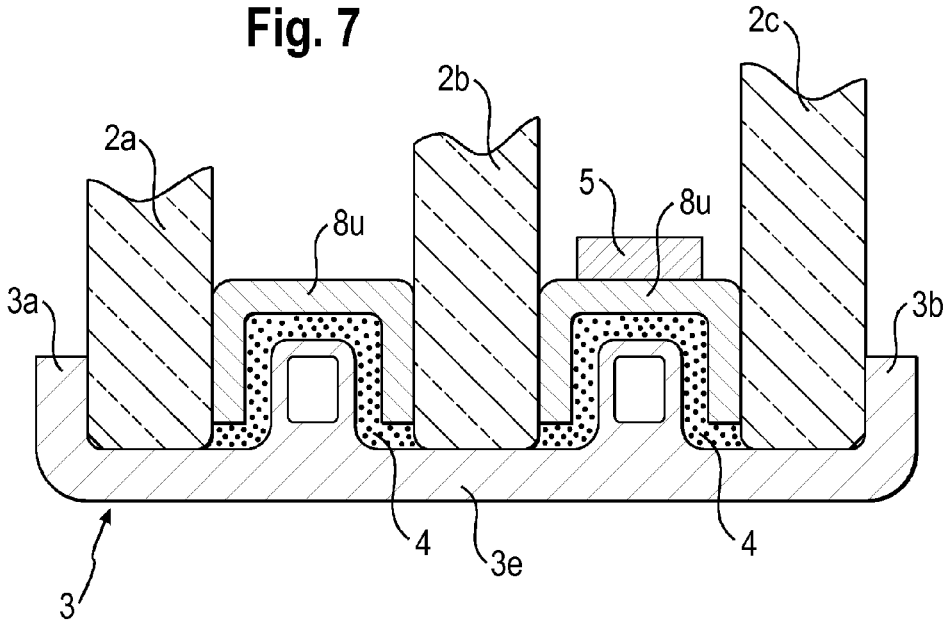
FIG. 7 a ninth embodiment with spacer and a modification of the same.
Figure 8:
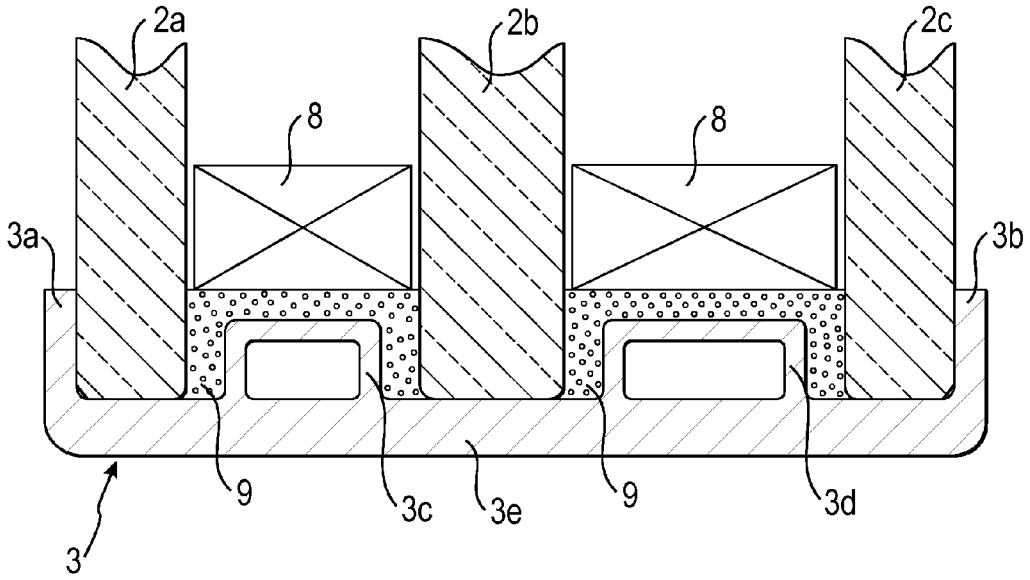
FIG. 8 a tenth embodiment with spacer and a modification of the same.

The ninth embodiment of the edge bond bracket 3 shown in FIG. 7 is adapted for the use of U-shaped spacers 8*u*. The bases 3*c, d* have widths in the transverse direction x, which are adapted such that the legs of the U-shaped spacers 8*u* fit between the panes 2*a*, 2*b*, 2*c* in addition to the adhesive 4 in the mounted state. That means, the widths are correspondingly reduced in comparison to the first to fifth and seventh embodiments. The bases 3*c*, 3*d* may in turn have different shapes, which include the provision of air chambers or cavities as shown in FIG. 7. It is again obvious from the design of the edge bond bracket 3 in FIG. 7 that all of the different diffusion barrier layers 11, 12, 13, 14, 14', as they were described with respect to the first to fifth embodiments, as well as the corresponding modifications of the protrusions and of the base wall 3*e*, may also be applied to the ninth embodiment. Alternatively, the variation is also possible that the spacers 8*u* include diffusion barrier layers and result in the diffusion barrier between the spacers 8*u* and the panes 2*a*, 2*b*, 2*c* in connection with the not-shown adhesives 4.

The tenth embodiment shown in FIG. 8 uses the spacer of the seventh embodiment in connection with an edge connection/bond that partially corresponds to the one of FIG. 11. Although, different from all other embodiments, no significant reduction of the height in which the spacer 8 is positioned between the glass panes 2*a*, 2*b*, 2*c* is achieved in the embodiment shown in FIG. 8, the thickness of the secondary sealant 9 is significantly reduced due to the introduction of the bases 3*c*, 3*d* (instead of secondary sealant 9). Obviously, the embodiment shown in FIG. 8 does not require any diffusion barriers in the edge bond bracket 3, if the spacers 8 include the diffusion barriers. If spacers 8 are used without diffusion barriers, all embodiments of the diffusion barriers 11, 12, 13, 14, 14' described with respect to the first to fifth embodiments can also be used in the tenth embodiment shown in FIG. 8.

In all embodiments, the thermal expansion coefficient of the edge bond bracket 3 is preferably adapted to the thermal expansion coefficient of the panes 2. For example, glass has a thermal expansion coefficient of ca. $7.6\times10^{-6}$ l/K, while, for example, polypropylene has a thermal expansion coefficient at room temperature which is higher by a factor 10 or more. Preferably, however, the material of which the bracket base body 30 is formed should have a thermal expansion coefficient in the range of the one of glass. This can be achieved, for example, by adding glass fibers in a corresponding amount to the plastic, like polypropylene, as a filler. Another possibility is to extrude a stainless steel sheet extending parallel to the pane 2 (z-y-plane) into the side walls 3*a*, 3*b* or to attach the same at the outside of the side walls 3*a*, 3*b*. Instead of a stainless steel sheet or another metal sheet, a glass fiber mat could be extruded into the same or to the outside. All these measures change the thermal expansion and adapt the same to that of the glass pane.

Figure 6:
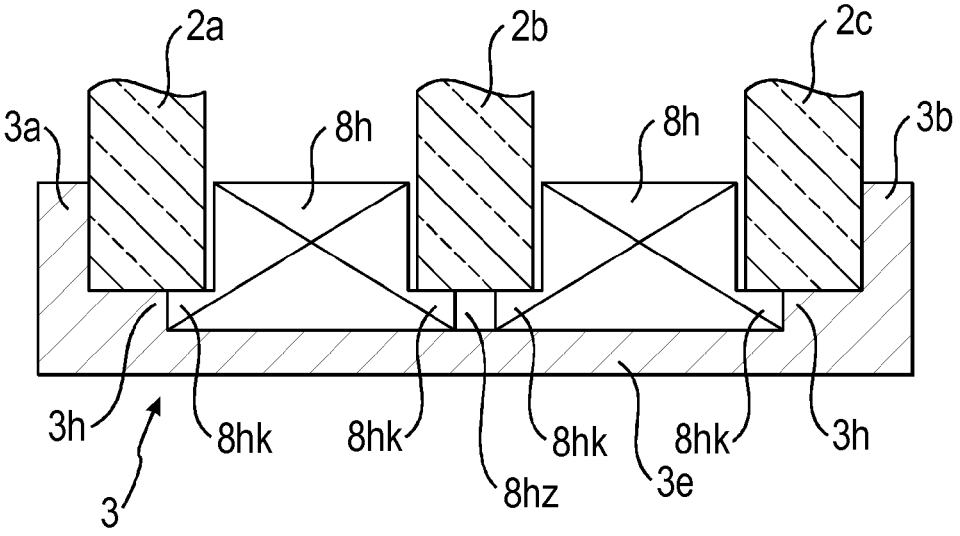
FIG. 6 an eighth embodiment with spacer and a modification of the same.
Figure 9:
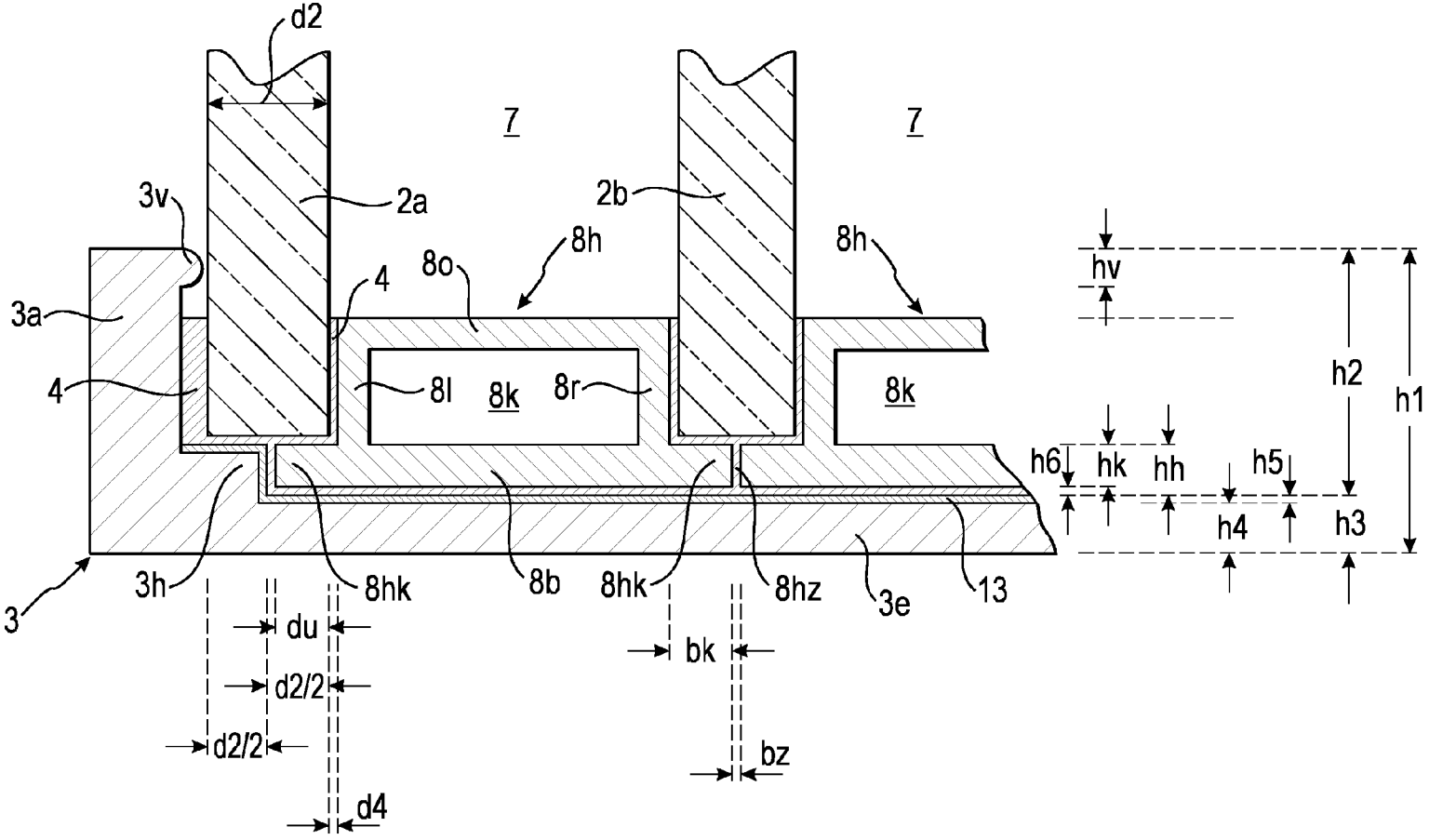
FIG. 9 an enlarged view of the portion of the representation of the eighth embodiment in FIG. 6.

An enlarged view of a portion of the depiction of the eighth embodiment of FIG. 6 is shown in FIG. 9. In this respect, the variant of the eighth embodiment having a diffusion barrier layer 13, which corresponds to the diffusion barrier layer 13 of FIG. 1, and the protrusions 3*v* is shown in FIG. 9. In the eighth embodiment, the bracket 3 is adapted for the usage of spacers. A modified shape of the spacers 8*h* is used, which, in cross-section perpendicular to the longitudinal direction z, have a "hat-shape", wherein the hat brim 8*hk* protrudes in the transverse direction x beyond the width b1 of the part of the spacers 8*h*, which is disposed between the panes 2*a*, 2*b* and 2*c*, respectively. It is thereby achieved that the panes can, at their bottom side in height direction y, stand on the protrusions/brims 8*hk*. The bracket 3 includes, adjacent to the side walls 3*a*, 3*b*, the protrusions 3*h* on the base wall 3*e*, the height hh of which corresponds to the height hk of the protrusions/brims 8*hk* of the spacers 8*h*. If a layer of the adhesive 4 or of another adhesive is to be provided between the base wall 3*e* and the spacer 8*h* (see FIG. 9), the height hk is selected to be slightly less than the height hh, in particular corresponding to the intended height h6 of the adhesive layer.

In the usual manner, the adhesive 4 is provided between the panes 2 adjacent to the spacer 8*h* and the side walls 8*b*, 8*r* of the spacer 8*h* in a thickness d4. In FIG. 9, the brims 8*hk* have widths bk in the transverse direction x, which exactly correspond to one-half of the pane thickness b2. Therefore, no empty space 8*hz* remains between the adjacent spacers 8*h* for this reason, except for a distance of about two times the adhesive thickness d4. the In case the spacer brims 8*h* of adjacent spacers 8*h* should abut on each other, the width bk can also be selected such that it corresponds to one-half the pane thickness plus the adhesive thickness d4 (hk=d2/2+d4).

The brim hk can also be provided on only one side of the modified spacer 8*h*. In that case, the width of the brim 8*hk* can be significantly larger than one-half of the pane thickness, for example, equal to the pane thickness. In this case, adjacent spacers can also abut on each other, if necessary with an equalization of the adhesive thickness b4 on both sides, i.e. with a width hk=d2+2d4.

Figure 10:
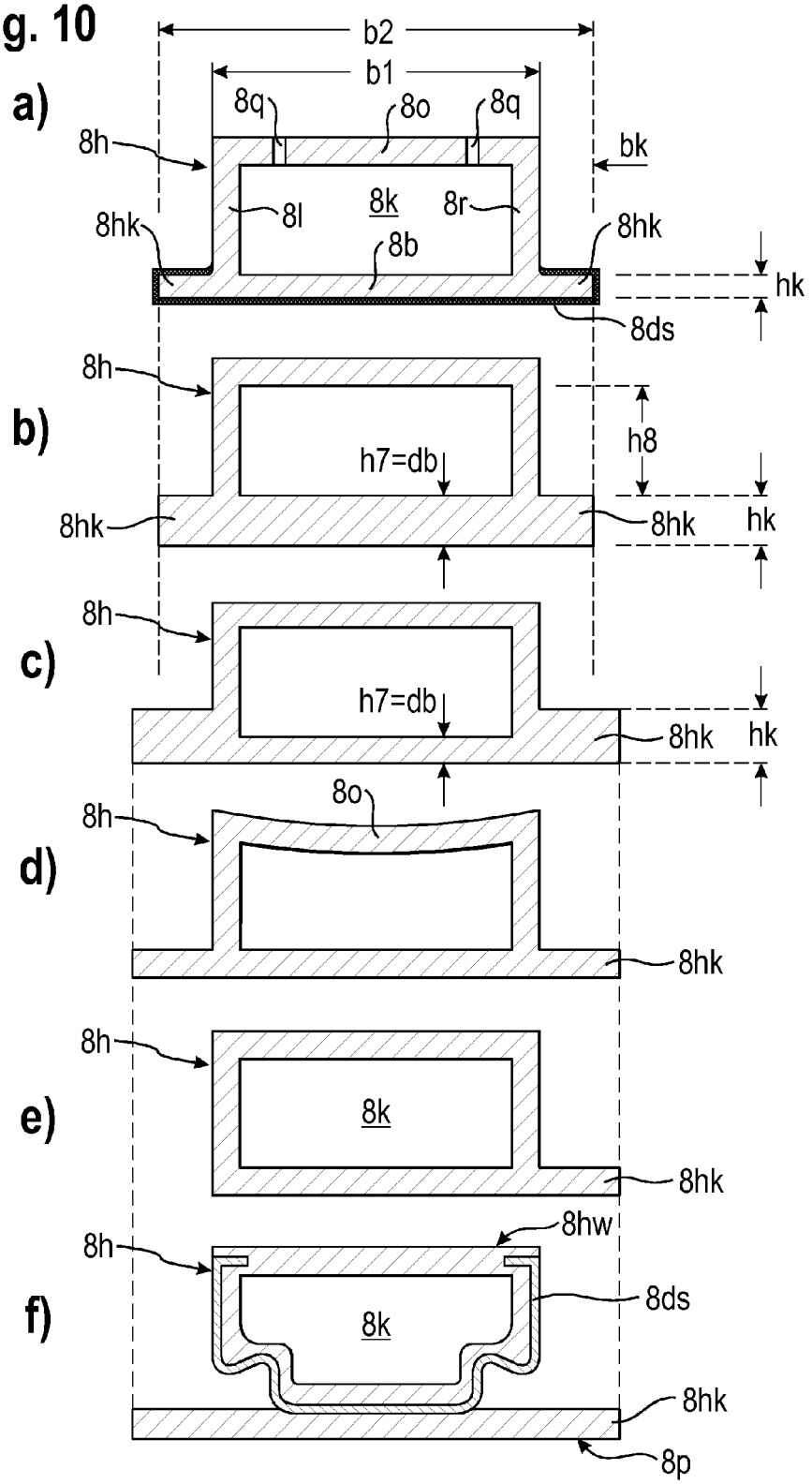
FIG. 10 an eleventh embodiment of a spacer and modifications of the same.

FIG. 10 shows the spacer 8*h* according to an eleventh embodiment in 6 modifications in a) to f). The spacers 8*h* are schematically shown. In FIG. 10*a*), a spacer 8*h* of the type as shown in FIGS. 6 and 9 is shown in larger detail. The spacer (separation holder) 8*h* extends in the longitudinal direction z with a constant cross-section (x-y) perpendicular to the longitudinal direction z. The spacer 8*h* has a body made of a material having a specific thermal conductivity ≤0.36 W/(mK), preferably ≤0.3 W/(mK), such as polyamide (PA), for example, PA66GF25, or a corresponding polyolefin, preferably polypropylene (PP) or the like, which have thermal conductivity values in the range of 0.2 W/(mK) or less. Usually, a spacer is described starting from the side facing the pane interspace 7. In this case, the body includes a base wall 8*o*, which is shown at the top, an upper wall 8*b* opposite to the base wall shown at the bottom at a distance h8, two spaced-apart side walls 8*l* and 8*r*, which extend essentially parallel to each other and essentially perpendicular to the base wall 8*o* and to the upper wall 8*b* and connecting the same, such that a hollow space (chamber) 8*k* is defined and is surrounded in the cross-section. The base wall is gas permeable, for example, due to perforations 8*q* in the base wall 80. Thereby, the pane interspace can communicate with the chamber, which is usually filled with a molecular sieve/desiccant. Thus far, the spacer 8 is not different from a conventional spacer. However, in the spacer 8*h* of FIG. 10*a*), protrusions are provided on both lateral sides, which look like hat brims in cross-section, i.e. like brims (flange protrusions, planar protrusions with planar, parallel upper and lower sides) 8*hk* having a height hk corresponding to the thickness db of the upper wall 8*b*, however, correspond to a flange 8. The brims 8*hk* have a thickness bk in the transverse direction x.

The variant of the spacer 8*h* shown in FIG. 10*a*) is provided a diffusion barrier layer 8*ds*, which extends continuously starting from the outer side of the one side wall 8*l* at the outside at the body of the spacer 8*h* and along the brim 8*h* adjacent to one side wall 8*l* and further along the outside of the upper wall 8*b* to the brim 8*hk* adjacent to the other side wall 8*r* and to the other side wall 8*r*. With such a diffusion barrier layer 8*ds* on the spacer 8*h*, the diffusion barrier layer shown in the variant in FIG. 9 is not necessary. The spacer 8*h* for the variant of an edge bond shown in FIG. 9 does not have the diffusion barrier layer 8*ds* for this reason. The possibility to provide a diffusion barrier layer 8*ds* and/or the possibility of a gas permeable embodiment of the base wall 8*o* are optional for all other modifications, although it is not shown everywhere in FIGS. 10*b*) to 10*f*).

As can be recognized in FIGS. 10*b*) to 10*f*), the height of the brims 8*hk* can be varied depending on the requirements. In particular, it is not necessarily identical to the wall thickness of the chamber walls (see FIG. 10*a*) to *c*)). The width bk of the brims can be varied depending on the requirements (see FIG. 10*a*) to *c*)). The base wall 8*o* can be formed concave (with respect to the chamber 8*k*) to improve the bending characteristics. The brim hk can be provided only on one side of the spacer 8*h* (see FIG. 10*e*)). A known spacer, such as, for example, a spacer 8*hw* known from WO 2006/027146 A1 can be re-designed into a spacer 8*h* having a hat-shape with brim by extruding a plate 8*p*. With respect to the material selection and the material thicknesses for the spacer 8*h*, reference is made to WO 2006/027146 A1, pages 6, 7, the teaching of which is applicable to spacer 8*h*.

It is explicitly stated that all features disclosed in the description and/or the claims are intended to be disclosed separately and independently from each other for the purpose of original disclosure as well as for the purpose of restricting the claimed invention independently of the compositions of the features in the embodiments and/or the claims. It is explicitly stated that all value ranges are indications of groups of entities disclosing every possible intermediate value or intermediate entity for the purpose of original disclosure as well as for the purpose of restricting the claimed invention, in particular as limits of value ranges.

The invention claimed is:

1. An edge bond bracket configured for use with an insulating glass unit, the edge bond bracket extending in a longitudinal direction (z) with a cross-section that is constant as viewed in a plane (x-y) perpendicular to the longitudinal direction, comprising:

a bracket body made of a first material having a specific thermal conductivity less than or equal to 0.3 W/(mK), the bracket body including a base wall, at least one base supported by the base wall, a first side wall and a second side wall, the side walls being connected to the base wall such that the base wall and side walls form a U-shape, wherein at least two troughs are defined in the base wall between the first side wall and the second side wall on an inner side of the U-shape, the troughs each being configured to accommodate adhesive and a pane of the insulating glass unit, and a gas-impermeable diffusion barrier layer that extends continuously through, and at least partially embedded in, the bracket body in a manner selected from:

(i) starting from an inner wall of one of the troughs and ending at an inner wall of an adjacent trough, (ii) starting from a bottom wall of one of the troughs and ending at a bottom wall of an adjacent trough, (iii) starting from an outer side of the at least one base and ending at an opposite outer side of the at least one base, and (iv) starting from an inner side of the first side wall and ending at an opposing inner side of the second side wall.

2. The edge bond bracket according to claim 1, wherein the troughs taper in a height direction (y) and/or are narrowed by projections extending in a transverse direction (x) from respective edges of the first and second side walls, which respective edges are opposite of the at least one base in the height direction.

3. The edge bond bracket according to claim 1, further comprising:

at least one functional element provided on the outer side of the U-shape.

4. The edge bond bracket according to claim 1, wherein recesses and/or cavities are defined on the outer side of the U-shape and/or in the bracket body.

5. An edge bond bracket configured for use with an insulating glass unit, the edge bond bracket extending in a longitudinal direction (z) with a cross-section that is constant as viewed in a plane (x-y) perpendicular to the longitudinal direction, comprising:

an at least substantially U-shaped bracket body made of a first material having a specific thermal conductivity less than or equal to 0.3 W/(mK), the bracket body including a first side wall and a second side wall, which extend in parallel and form first and second legs of the U-shape, and a bottom wall connecting the first and second side walls, an inner side of the U-shape being defined by inwardly-facing sides of the first and second legs and the bottom wall, and a diffusion barrier layer integrally formed with the bracket body and extending continuously either along an outer side of the U-shape of the bracket body or through the bracket body starting from an inner side of the first leg and ending on an opposing inner side of the second leg.

6. An insulating glass unit comprising:

at least two panes disposed parallel to each other so as to define at least one pane interspace therebetween, the edge bond bracket according to claim 5 having the at least two panes respectively affixed in the at least two troughs, and a gas-impermeable adhesive disposed adjacent to, and continuous with, the gas-impermeable diffusion barrier layer of the edge bond bracket such that a gas-impermeable barrier is formed and seals the at least one interspace between adjacent panes in a gas-impermeable manner.

7. An insulating glass unit comprising:

at least two panes disposed parallel to each other so as to define at least one pane interspace therebetween, the edge bond bracket according to claim 1 having the at least two panes respectively affixed in the at least two troughs, and a gas-impermeable adhesive disposed adjacent to, and continuous with, the gas-impermeable diffusion barrier layer of the edge bond bracket such that a gas-impermeable barrier is formed and seals the at least one interspace between adjacent panes in a gas-impermeable manner.

8. The edge bond bracket according to claim 1, wherein the first material comprises polypropylene (PP), polyvinyl chloride (PVC) or a polycarbonate-Acrylonitrile Butadiene Styrene (ABS) blend.

9. The edge bond bracket according to claim 8, wherein the first material further comprises glass fibers.

10. The edge bond bracket according to claim 9, wherein the gas-impermeable diffusion barrier layer comprises a metal layer, a metal foil or a layer of a gas-impermeable plastic.

11. The edge bond bracket according to claim 10, wherein the gas-impermeable diffusion barrier layer has a thickness less than or equal to 0.2 mm.

12. The edge bond bracket according to claim 9, wherein the gas-impermeable diffusion barrier layer comprises a metal layer or a metal foil comprising stainless steel or zinc-coated steel and having a thickness less than or equal to 0.1 mm.

13. The edge bond bracket according to claim 9, wherein the gas-impermeable diffusion barrier layer comprises Ethylene Vinyl Alcohol (EVOH).

14. The edge bond bracket according to claim 1, wherein the gas-impermeable diffusion barrier layer comprises a metal layer, a metal foil or a layer of a gas-impermeable plastic and has a thickness less than or equal to 0.2 mm.

15. The edge bond bracket according to claim 1, wherein the gas-impermeable diffusion barrier layer comprises a metal layer or a metal foil comprising stainless steel or zinc-coated steel and having a thickness less than or equal to 0.1 mm.

16. The edge bond bracket according to claim 1, wherein the gas-impermeable diffusion barrier layer comprises Ethylene Vinyl Alcohol (EVOH).

17. An edge bond bracket configured for use with an insulating glass unit, the edge bond bracket extending in a longitudinal direction (z) with a cross-section that is constant as viewed in a plane (x-y) perpendicular to the longitudinal direction, comprising:

a bracket body made of a first material having a specific thermal conductivity less than or equal to 0.3 W/(mK), the bracket body including a base wall, at least one base supported by the base wall, a first side wall and a second side wall, the side walls being connected to and forming a U-shape with the base wall, wherein at least two troughs are defined in the base wall between the first side wall and the second side wall on an inner side of the U-shape, the troughs each being configured to accommodate adhesive and a pane of the insulating glass unit, and a gas-impermeable diffusion barrier layer formed on the bracket body and integrally therewith, wherein the diffusion barrier layer extends continuously along an outer side of the U-shape of the bracket body starting from an inner wall of one of the two troughs and ending on an inner wall of the other of the two troughs.

18. The edge bond bracket according to claim 16, wherein the troughs taper in a height direction (y) and/or are narrowed by projections extending in a transverse direction (x) from respective edges of the first and second side walls, which respective edges are opposite of the at least one base in the height direction.

19. The edge bond bracket according to claim 16, wherein the first material comprises polypropylene (PP), polyvinyl chloride (PVC) or a polycarbonate-ABS blend.

20. The edge bond bracket according to claim 18, wherein the first material further comprises glass fibers.

* * * * *